US006449883B1

(12) United States Patent
Vandycke

(10) Patent No.: US 6,449,883 B1
(45) Date of Patent: Sep. 17, 2002

(54) METHOD AND DEVICE FOR DREDGING UNDERWATER GROUND LAYERS

(75) Inventor: Stefaan Vandycke, Bredene (BE)

(73) Assignee: Dredging International B.V. (BE)

( * ) Notice: Subject to any disclaimer, the term of this patent is extended or adjusted under 35 U.S.C. 154(b) by 0 days.

(21) Appl. No.: 09/636,830

(22) Filed: Aug. 14, 2000

Related U.S. Application Data

(63) Continuation-in-part of application No. PCT/BE99/00018, filed on Feb. 10, 1999.

(30) Foreign Application Priority Data

Feb. 13, 1998 (BE) ..... 9800111

(51) Int. Cl.[7] ..... E02F 5/02
(52) U.S. Cl. ..... 37/323
(58) Field of Search ..... 37/78, 91, 189, 37/190, 317, 322, 323, 343, 349; 299/17, 39, 67, 81

(56) References Cited

U.S. PATENT DOCUMENTS

| | | | | | |
|---|---|---|---|---|---|
| 3,554,602 | A | * | 1/1971 | Chaney | 37/344 |
| 3,706,185 | A | * | 12/1972 | Chaplin | 56/9 |
| 4,150,503 | A | * | 4/1979 | Lespinasse | 37/71 |
| 4,573,743 | A | * | 3/1986 | Grathoff | 299/39 |
| 4,586,850 | A | | 5/1986 | Norman et al. | |
| 4,705,321 | A | | 11/1987 | Hedlund | |
| 4,946,227 | A | * | 8/1990 | Paul | 299/39 |

FOREIGN PATENT DOCUMENTS

| | | |
|---|---|---|
| BE | 356816 | 12/1928 |
| DE | 2 223 942 | 11/1973 |
| DE | 33 46 306 A1 | 7/1985 |
| DE | 35 21 560 A1 | 5/1986 |
| DE | 38 17 213 C1 | 1/1989 |
| EP | 0 078 080 | 5/1983 |
| GB | 1 422 693 | 1/1976 |
| JP | 05039696 | 2/1993 |
| WO | WO 94/25191 | 11/1994 |

* cited by examiner

*Primary Examiner*—Robert E. Pezzuto
(74) *Attorney, Agent, or Firm*—Venable; George H. Spencer; Ashley J. Wells

(57) ABSTRACT

An apparatus and method for dredging under water ground layers includes the steps of providing a dredging device composed of a mechanical dredging component having a part operative to contact the under water ground layers and exert a dredging action; and at least one water jet effective to inject water under pressure in an area where the mechanical dredging component is operative; mechanically impacting the underwater ground layers with the part to fracture the underwater ground layers and form fractured material; and injecting water under pressure from the at least one water jet simultaneously with the mechanical impacting to remove the fractured material so that an improved break-away pattern of material is obtained and reduced wearing of said part.

22 Claims, 4 Drawing Sheets

METHOD AND DEVICE FOR DREDGING UNDERWATER GROUND LAYERS

CROSS-RERERENCE TO RELATED APPLICATIONS

This application is a continuation-in-pat of co-pending PCT/BE99/00018, filed on Feb. 10, 1999, which claims the priority of Belgian Application 9800111, filed on Feb. 13, 1998. The subject matter of both applications is incorporated herein by reference.

BACKGROUND OF THE INVENTION.

1. Field of the Invention

This invention relates to a method for working through ground layers for dredging under water ground layers by means of a dredging device, the dredging device comprising a mechanical dredging component with a part operative to contact the ground layers to exert a dredging action to the ground layers in the course of a dredging action, in which method the part is brought into contact with the ground layers and water jets are injected in the area where the mechanical dredging component is operative.

2. Description of the Related Art

In dredging operations with dredgers or excavators of various types, it has become use to inject high pressure water jets into an area in front of the cutting or dredging component. Thereby, the high pressure water jets may be mixed with air or not. The injection of high pressure water jets has particularly been used in combination with suction hopper dredgers when dredging sandy grounds to cause the sandy grounds to fluidize. The main purpose thereof is to enhance the cutting, suction and pumping process in sandy grounds and to cause a stirring-up of the sludge particles in the water in sludge-like grounds, so that the particles can be moved by the ambient natural water currents and the use of transport vehicles can be avoided. The pressures used in this technique lie in the order of magnitude of 10 bar with a tendency to increase the pressure to about 15–20 bar.

From DE-A-3521560, a method is known for digging dry ground layers with a firm hardness such as for example rocks. In the method of DE-A-3521560, the rock like ground layers are digged by means of an excavator equipped with teeth for dredging the ground layers. High pressure water jets impact the grounds to be excavated with a high energy density and impart a cutting action thereto, thus involving the formation of fissures and cracks which can then be split by the sharp side of the teeth of the excavator. Simultaneously, the size of the parts resulting from the digged grounds is reduced, so that the reduced rocks need not be transported and can be left at the digged location. The pressure of the water jets is mostly between 40 and 400 Mpa.

The method disclosed in DE-A-3521560 however concerns the excavation of dry grounds, which cannot be applied to under water dredging just like that. Namely, the impact of high pressure water jets after displacement through water, will be significantly lower than the impact of a high pressure water jet on a dry ground after displacement through the environmental air. In addition to this, the impact of a high pressure water jet on a dry ground being known, its impact on an under water ground layer cannot be predicted just like that, as it will a.o. strongly vary with the pressure of the water jet and the propagation distance through the water.

It is the aim of the present invention to provide a method for dredging under water ground layers in which the mechanical cutting forces applied by the dredging device can be reduced, which allows harder ground types to be dredged with a machine power which would otherwise be used for dredging grounds with a softer constitution, and with which a higher cutting, suction and pressing production can be attained in identical ground types.

SUMMARY OF THE INVENTION

The above outlined purposes of the invention can be achieved with the technical features that the dredging action of the dredging component and the injection of the water jets are carried out simultaneously and the water jets are injected at a pressure of at least 20 bar at the position of, through and/or behind the mechanical dredging component.

In the method of this invention, water jets are injected in the area where the mechanical dredging component is operative, the dredging action of the dredging component and the injection of the water jets being carried out simultaneously. Thereby, the water jets are preferably injected at a pressure of at least 20 bar at the position of, through and/or behind the mechanical dredging component.

The simultaneous dredging action of the dredging component and injection of high pressure water jets allows an optimised co-action of both to be obtained. The result of the optimised co-action depends on the type of ground to be dredged and can be summarised as follows. Because of the optimised co-action it becomes possible to enhance in the immediate vicinity of an area of a rock-like material that has been cut by the dredging device hydraulic fracturing in the non-crushed part thereof, to cut open ground layers such as clay layers and/or fluidize ground layers such as sand layers in the vicinity of the cutting or dredging component. The optimised co-action also results herein that broken-off and crushed material can be immediately removed by the high pressure water jets from the location where the mechanical cutting or dredging component is active, in particular in case the ground layers contain rock-like materials or consist virtually or exclusively of rock-like materials such as rock layers.

It has been found that simultaneously with the improved dredging operation of the dredging device, the wear of the dredging components can be reduced, including wear of the teeth thereof. Also, in case of dredging sandy materials, the dredging efficiency can be improved. It has namely been found that when dredging sand grounds, the sand is fluidized by the action of the water jets. The fluidized sand presents the advantage that it can be pumped as a fluid, and not as a water/sand mixture, so that the pump efficiency can be improved.

In the method of this invention, ground layers are understood to include gravel, sand and clay layers or ground layers containing rock-like materials or consisting virtually exclusively of rock masses such as rock layers. Examples of dredging devices suitable for use in the method of this invention include suction hopper dredgers, cutter suction dredgers, bucket dredgers, grab dredgers, pull shovel pontoons or the like. Each of these devices comprises a mechanical cutting or dredging component, part of which comes into contact with the ground and/or rock layers for dredging.

In case the dredging device is a hopper dredger, preferably water jets are also injected to the ground layers to be dredged at a pressure of at least 50 in front of the mechanical dredging component. In that way an optimum fluidization of the soil or an optimum cutting of the clay can be achieved before it enters the draghead.

In specific conditions, in particular when the ground layers contain rock-like materials or consist virtually exclusively of rock-like materials and use is made of a cutter dredger, water jets are injected at pressures of preferably at least 100, preferably from at least 600 to 2000 bar, for example 620 bar. Such a water jet is capable of blowing away the crushed zone that has been created by the mechanical cutting tool.

BRIEF DESCRIPTION OF THE DRAWINGS

The invention is further illustrated in the attached figures and the description of the figures.

DESCRIPTION OF THE PREFERRED EMBODIMENTS

As has been explained above, the method of this invention is based on an optimal co-action of the mechanical cutting or dredging component of the dredging device and the water jets injected under pressure in the ground layers to be dredged. The pressure of the water jets is selected such that it is capable of exerting a hydraulic cutting or dredging action to the ground layers at the time the ground layer is being cut by a mechanical cutting, dredging tool.

Figure 1:
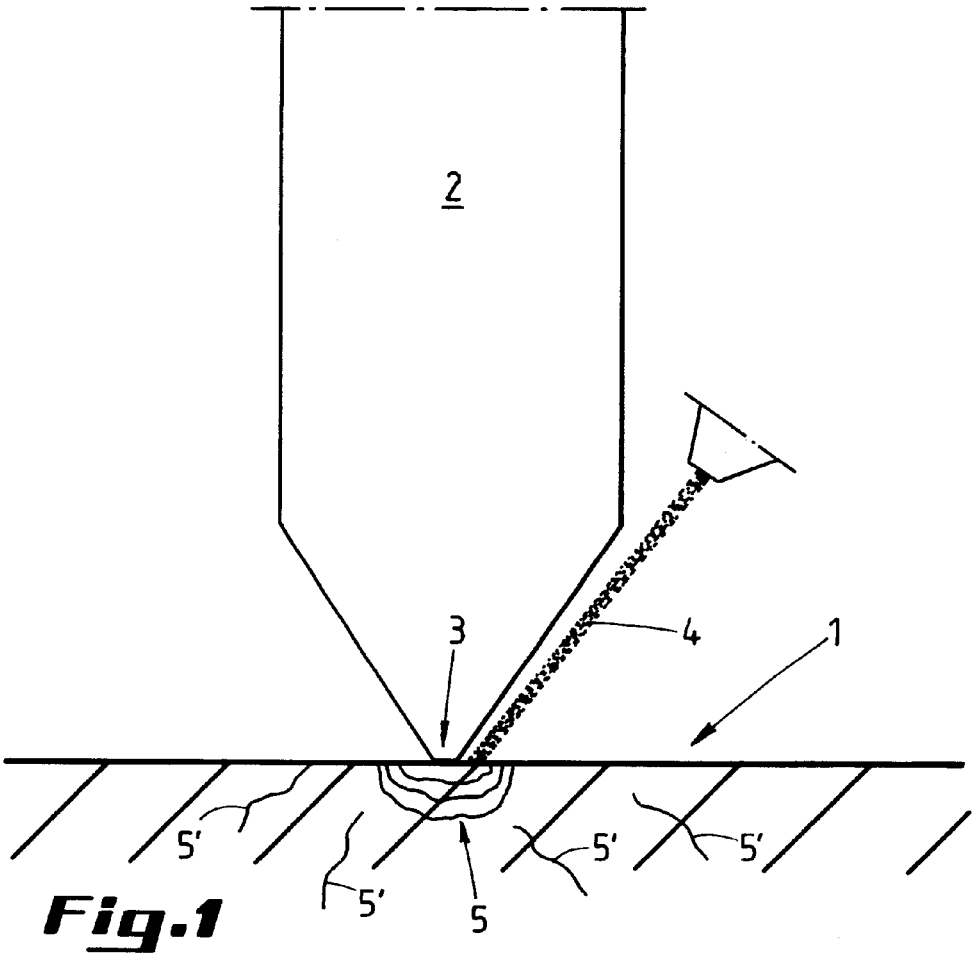
FIG. 1 is a schematic illustration of the principle of the method of the invention, when using a tooth as mechanical cutting or dredging component on rock-like ground layers.

In FIG. 1, the mechanical cutting action of a tooth 2 of a dredging device on a stone like ground mass 1 is illustrated. As can be seen from FIG. 1, a ground layer to be dredged is impacted by a tooth 2 of a dredging device at an impact position 3. The impact of the tooth 2 creates a first fracture zone 5 in the ground mass. Simultaneously with the impact of the tooth 2, a high pressure water jet 4 is injected into the ground layer as close as possible to the impact position 3 of the tooth 2, so as to allow the crushed stone-like materials to be virtually completely removed from fracture zone 5. The water jet has a pressure of at least 20 bar and may be injected either at the position of, through and/or behind the dredging component. As a result of the positioning and the selected pressure of the water jet 4, the fracture zone 5 created upon impact of tooth 2 is increased by hydraulic fracturing of the ground mass and results in a hydraulic fracture zone 5'. The above described co-action of the tooth 2 of the dredging component and the high pressure water jet 4 thus allow the grounds to be dredged with an improved efficiency, while simultaneously the extent of wearing of the tooth 2 can be decreased. Namely, due to the action of the high pressure water jet 4, the fracturing 5 is enhanced by the hydraulic fracturing 5', so that an improved break-away pattern of material can be achieved.

To achieve an optimum fracturing, the tooth should be disposed such that during cutting of the ground the impact point 3 of the tooth and the water jet 4 coincide as much as possible.

When the pressure of the water jet 4 is sufficiently high and preferably amounts to at least 100, this fracture zone will then initiate further cracking and further hydraulic fracturing of the ground layers. Simultaneously, breakage remnants are removed from the fracture zone 5' by the high pressure water jets. The enforced fracturing of the ground layer by the high pressure water jets allows to decrease the cutting power, while maintaining the extent of fracturing thus allowing the wear of the teeth to be decreased. As a large part of the broken-off materials associated with the fracture zone 5' are removed by the water jet 4, the wear of the teeth can be further reduced.

Figure 2:
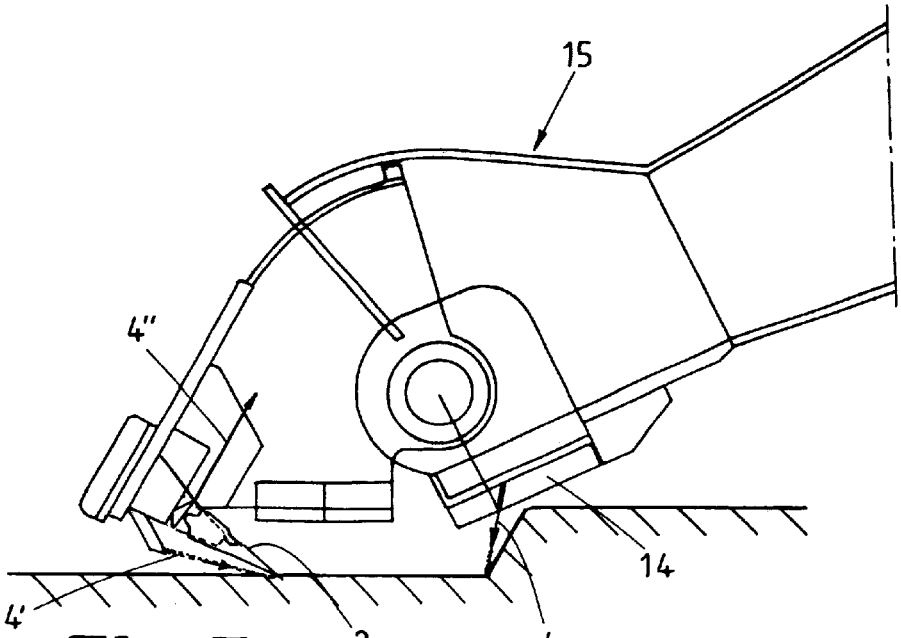
In FIGS. 2 and 3 a schematic illustration of the method of this invention is given, when using a suction hopper dredger (side view).
Figure 3:
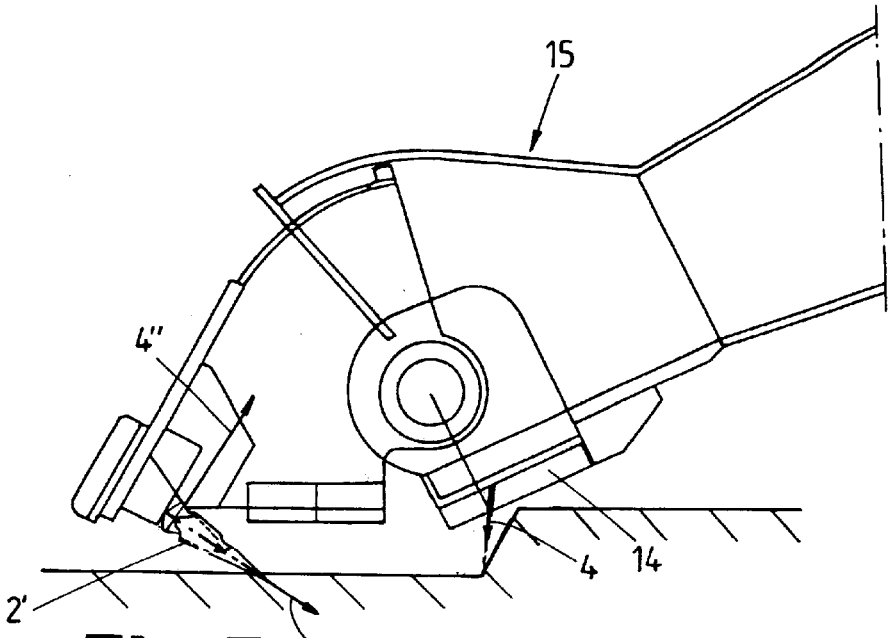
Figure 4A:
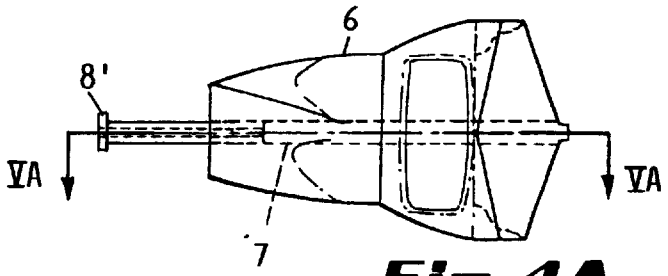
FIG. 4A is a side view of a possible embodiment of an adapter for receiving a tooth.
Figure 4:
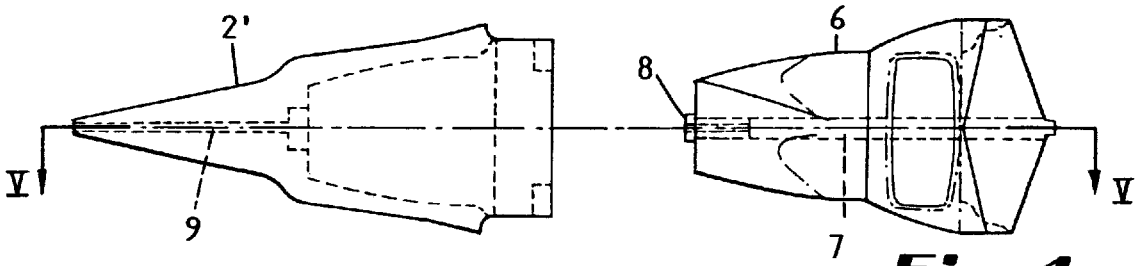
FIG. 4 is a side view of a tooth with adapter in a preferred embodiment of to the invention, with at least one high pressure water being injected through the tooth.
Figure 5A:
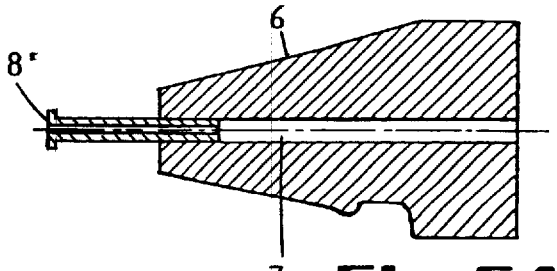
FIG. 5A is a longitudinal section along the same line of the adapter of FIG. 4A.
Figure 5:
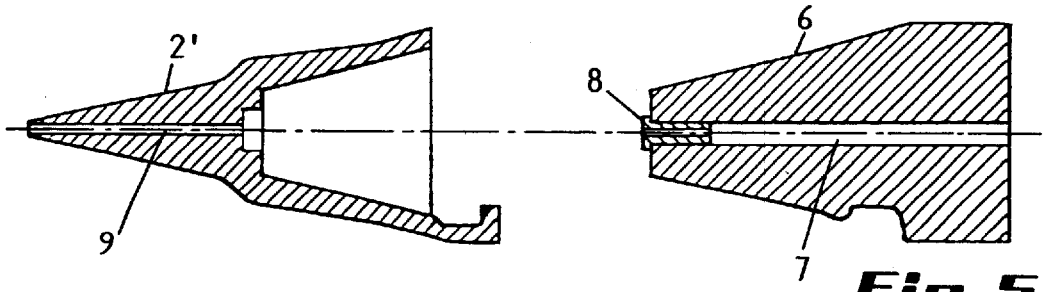
FIG. 5 is a cross-section along the line v—v of FIG. 4.

It is important that the water jet impacts the ground layer to be dredged as close as possible to the impact point of the cutting tooth to allow the crushed material to be blown away or removed from the dredging zone. This can be achieved by positioning the nozzle through which water jet 4 is injected right behind the tooth 2 as is illustrated in FIG. 2. In another preferred embodiment shown in FIG. 3, the tooth 2' is designed such that water jet 4' is injected through the tooth 2'. In the afore described embodiments, To reduce the wearing of the teeth as a function of time and achieve that they wear less rapidly, in particular when used in rock-like ground masses, the tooth 2 is preferably constructed as shown in FIGS. 4, 4A, 5, 5A and 6. To facilitate replacement, each tooth 2' is mounted on an adapter 6 which for instance forms part of the dredging device, for example a rotating cutter, or is fixed on a transverse beam of the draghead of the dredger. As can be seen from FIGS. 4, 4A, 5, 5A, 6 and 7, adapter 6 preferably comprises at least one high-pressure conduit 7. In tooth 2 or 2' a bore 9 is provided which is provided to fit to conduit 7. Conduit 7 preferably gives access to a short nozzle 8 or an extended nozzle 8' which, when tooth 2' is mounted on adapter 6, comes to lie in the line of the bore 9 running through tooth 2'. In this way a high pressure water jet is injected through the tooth 4 of the dredging component of the dredging device.

The above described construction of the tooth results in a maximum co-action between tooth and high-pressure water jet, which results in a considerable reduction in the wear of the tooth. When dredging is carried out in rock-like ground masses or rocks, the broken-off materials will be removed by the high-pressure water jets so that the teeth will operate in the most favourable conditions.

Figures 6, 7:
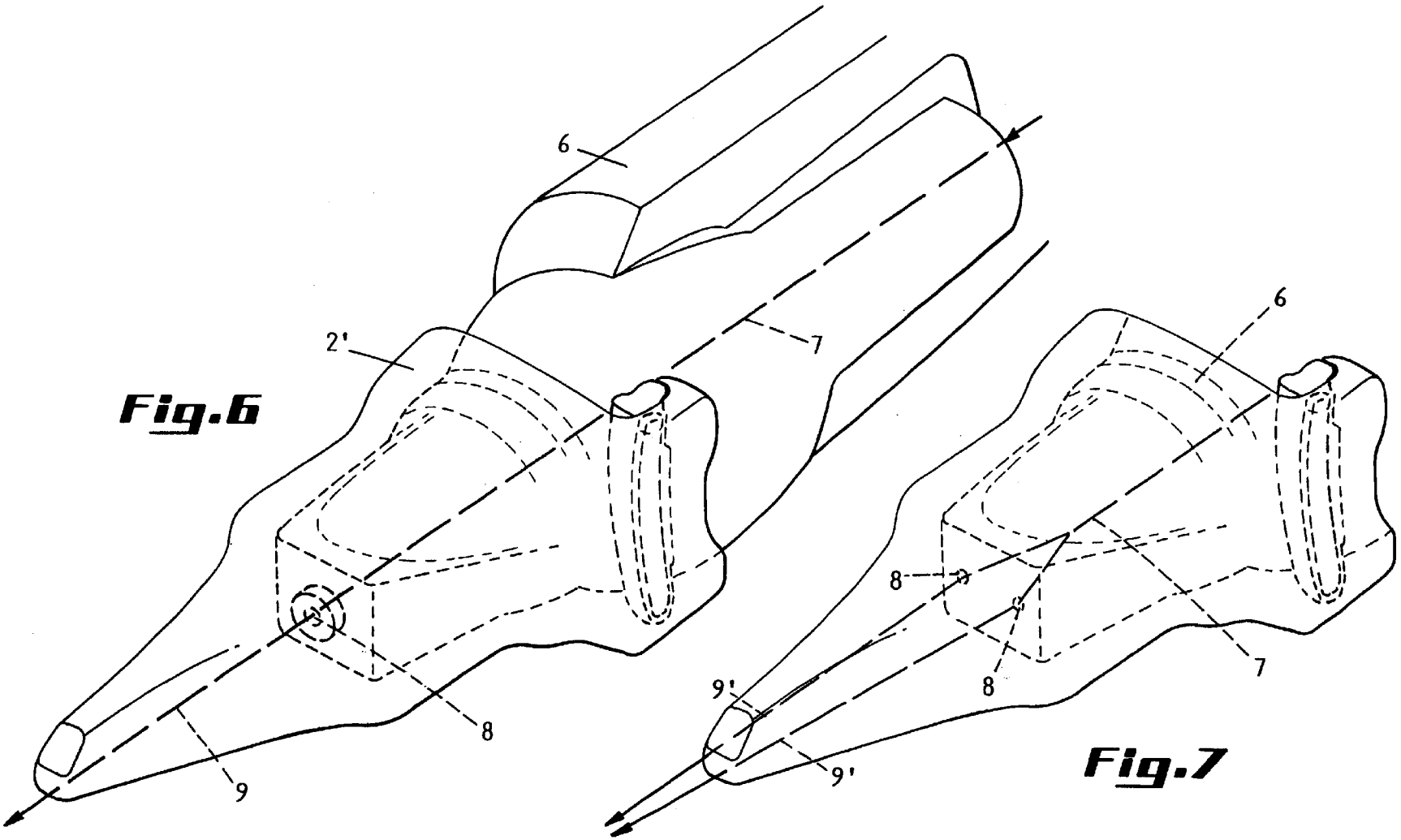
FIG. 6 is a perspective view of a preferred embodiment of an adapter with teeth mounted thereon.
FIG. 7 shows in perspective view a variant of the embodiment of FIG. 6.

A variant of the embodiment described by FIG. 6 consists of providing two bores 9' through tooth 2' and providing the adapter with two nozzles 8 or 8'. Both bores 9' must be directed such that, as the outer end of tooth 2' wears, an injection by both water jets under high pressure toward the impact point of the tooth continues to take place which becomes wider as the tooth wears. The use of two or more water jets may be advisable in case the equipment used is large and heavy as compared to the dimensions of the water jets, so as to allow the water jets to approximately cover the whole impact area of the tooth. Both bores 9' are preferably oriented such that as the outer end of tooth 2' wears, an injection by both water jets towards the impact point of the tooth continues to take place, and that the impact point of the water jets increases with the wearing of the tooth.

Figure 8:
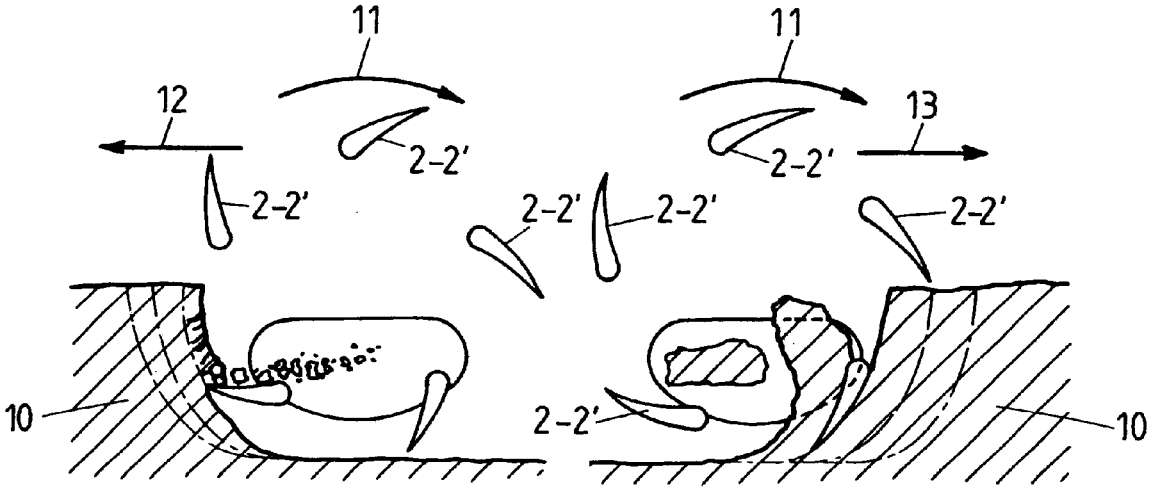

FIG. 8 shows very clearly the method according to the invention for a suction cutter dredger. The same FIG. shows schematically the operation of teeth 2 or 2' in the ground or rock mass 10 for the same rotation direction and two opposed swinging movements of the suction cutter dredger. The rotation direction is indicated with arrows 11, the swinging movements with arrows 12 and 13.

It is noticeable that the water jets under high pressure are injected at least for a duration which corresponds with the time for which the teeth 2 or 2' are active, i.e. remain in contact with the ground mass for dredging or dredging. Due to the action of the high-pressure water jets the broken materials are removed so that they do not obstruct the optimal operation of the teeth and ensure the increased lifespan of the teeth. The action of the high-pressure water jets also initiates and enhances the hydraulic fracturing.

It is therefore necessary in this option to ensure by means of valves the water flow rate under high pressure to at least the "active" or operational teeth.

When the invention is applied on suction hopper dredgers, a plurality of dispositions of the high-pressure water jets can be devised. Reference is made once again to FIGS. 2 and 3 as an example of suction hopper dredgers. The nozzles for high-pressure water jets 4 of at least 50 are mounted on the heel plate 14 of draghead 15 and provide a first hydraulic working of the ground.

A second row of nozzles is arranged behind teeth 2, this such that water jets 4' of at least 20 bar are directed toward the outer end of teeth 2, with a second row of nozzles for injecting water jets 4" of at least 20 bar toward the interior of the draghead 15 to cause the already cut material to undergo an additional cutting operation. In such a suction hopper dredger use can also be made of the above described tooth structure which enables injection of the water jets through tooth 21 with its adapter 6. If water jets 4 are caused to act from the heel plate 14 of draghead 15 in one line between respective teeth 2 or 2', these water jets then provide an initially vertical cutting or fracture plane in one line between teeth 2 or 2', while water jets 4' and 4" with the teeth 2 or 2' co-acting therewith cause further fracture of the intermediate ground material of these vertical planes.

In firm clay layers and harder sand layers the above described arrangement offers very great advantages, since with the currently applied techniques it is only possible to dredge with suction hoppers with a great propulsion power or with a stationary suction cutter dredger. In dredging with an apparatus according to the invention in said harder sand layers or firm clay layers the efficiency increases because the ground layers are already partly broken, simultaneously or not, by the action of the high-pressure water jets.

What is claimed is:

1. A method for dredging under water ground layers, the method comprising the steps of:

providing a dredging device comprised of a mechanical dredging component having a part operative to contact the under water ground layers and exert a dredging action on the under water ground layers; and at least one water jet effective to inject water under pressure in an area where the mechanical dredging component is operative;

mechanically impacting the underwater ground layers with said part of the mechanical dredging component to fracture the underwater ground layers and form fractured material; and injecting water under pressure from said at least one water jet simultaneously with the mechanical impacting to remove the fractured material so that an improved break-away pattern of material is obtained and reduced wearing of said part, wherein the at least one water jet is operated at a pressure of at least 20 bar and at least one position selected from the group consisting of (a) at a position which is the same position as that of the mechanical dredging component, (b) at a position which causes the water to flow through the mechanical dredging component, (c) at a position which is behind that of the mechanical dredging component, and (d) at a position which is in front of that of the mechanical dredging component.

2. The method as claimed in claim 1, wherein the at least one water jet is positioned at a position which is in front of that of the mechanical dredging component and is operated at a pressure of at least 50 bar.

3. The method as claimed in claim 1, wherein the at least one water jet is operated at a pressure of at least 100 bar.

4. The method as claimed in claim 1, wherein the at least one water jet is operated at a pressure of at least 600 bar.

5. The method as claimed in claim 1, wherein the dredging device is a suction hopper dredger having a draghead which is moved in a displacement direction in use and which is equipped with a plurality of teeth which extend in a line in a direction transverse to the displacement direction of the draghead, and wherein the at least one water jet is a plurality of water jets.

6. The method as claimed in claim 5, wherein the plurality of water jets comprises at least one of (a) a plurality of water jets positioned respectively in front of the plurality of teeth taken in the displacement direction and operated at a pressure of at least 50, (b) a plurality of water jets positioned respectively behind the plurality of teeth taken in the displacement direction and operated at a pressure of at least 20 bar, (c) a plurality of water jets positioned respectively between the plurality of teeth taken in the displacement direction and operated at a pressure of at least 20 bar, and (d) a plurality of water jets positioned respectively within the plurality of teeth, flowing through the respective teeth taken in the displacement direction and operated at a pressure of at least 20 bar.

7. The method as claimed in claim 5, wherein, at the position of the plurality of teeth, the plurality of water jets inject water at a pressure of at least 20 bar in a direction toward the inside of the draghead.

8. The method as claimed in claim 1, wherein the dredging device is a suction cutter dredger.

9. The method as claimed in claim 8, wherein the high-pressure water is injected exclusively during the effective operation of the dredging component of the dredging device.

10. The method as claimed in claim 1, wherein the dredging device is a bucket dredger.

11. The method as claimed in claim 1, wherein the dredging device is a pull shovel pontoon and grab dredgers.

12. A dredging device for dredging under water ground layers, comprising:

a mechanical dredging component having a part operative to contact the under water ground layers and exert a dredging action on the under water ground layers in use so that mechanical impacting fractures the under water ground layers and forms fractured material; and means for ejecting a high pressure water jet to the under water ground layer simultaneously with mechanical impacting in an area where the mechanical dredging component is active in use so that fractured material is removed and an improved break-away pattern of material is obtained and reduced wearing of said part, wherein said part comprises at least one high pressure water injection nozzle for injecting water into the under water ground layers at a pressure of at least 20 bar and at least one position selected from the group consisting of (a) at a position which is the same position as that of the mechanical dredging component, (b) at a position which causes the water to flow through the mechanical dredging component, (c) at a position which is behind that of the mechanical dredging component, and (d) at a position which is in front of that of the mechanical dredging component and for which the pressure is at least 50 bar.

13. The device as claimed in claim 12, wherein the at least one high pressure water injection nozzle is operated at a pressure of at least 100.

14. The device as claimed in claim 12, wherein the at least one high pressure water injection nozzle is operated at a pressure of at least 2000 bar.

15. The device as claimed in claim 12, wherein the dredging device is a suction hopper dredger having a draghead which is moved in a displacement direction in use and which is equipped with a plurality of teeth which extend in a line in a direction transverse to the displacement direction of the draghead, and wherein the at least one high pressure water injection nozzle is a plurality of nozzles provided respectively between the plurality of teeth.

16. The device as claimed in claim 12, wherein the dredging device is a suction hopper dredger having a draghead which is moved in a displacement direction in use and which is equipped with a plurality of teeth which extend in a line in a direction transverse to the displacement direction of the draghead, and wherein the at least one high pressure water injection nozzle is a plurality of nozzles positioned behind respective teeth of the plurality of teeth for injecting high-pressure water jets under the respective teeth in a direction toward the outer end of the respective teeth.

17. The device as claimed in claim 12, wherein the dredging device is a suction hopper dredger having a draghead which is moved in a displacement direction in use and which is equipped with a plurality of teeth which extend in a line in a direction transverse to the displacement direction of the draghead, and wherein the at least one high pressure water injection nozzle is a plurality of nozzles provided in the draghead for injecting high pressure water jets in a direction toward the interior of the draghead.

18. The device as claimed in claim 12, wherein the dredging device is a suction hopper dredger having a heel plate.

19. The device as claimed in claim 12, wherein the dredging device is a cutter suction dredger having a cutter head including arms, the arms of the cutter head having a plurality of teeth mounted on adapters, the plurality of teeth being provided with respective nozzles for injecting high-pressure jets toward an impact point of respective ones of the plurality of teeth.

20. The device as claimed in claim 12, wherein the dredging device is a bucket dredger comprising a plurality of buckets, each bucket of the plurality of buckets comprising an edge provided to contact the under water ground layers during dredging action, and comprising high pressure water injection nozzles.

21. The device as claimed in claim 12, wherein the dredging device is a pull shovel pontoon having a shovel comprising an edge for contacting the under water ground layers during dredging action, the edge being provided with high pressure water injecting nozzles.

22. A tooth mounted on an adapter for use in a device as claimed in claim 12, wherein both the tooth and the adapter on which it is mounted have at least one axial bore for injecting high pressure water jets in a direction toward a position where the tooth contacts the under water ground layers.

* * * * *